US008668762B2

(12) United States Patent
Kim et al.

(10) Patent No.: US 8,668,762 B2
(45) Date of Patent: Mar. 11, 2014

(54) METHOD FOR MANUFACTURING DESULFURIZING AGENT

(71) Applicant: Korea Institute of Industrial Technology, Chungcheongnam-do (KR)

(72) Inventors: Shea Kwang Kim, Seoul (KR); Jung Ho Seo, Gyeongsangnam-do (KR); Dong In Jang, Seoul (KR)

(73) Assignee: Korea Institute of Industrial Technology, Chungcheongnam-do (KR)

( * ) Notice: Subject to any disclaimer, the term of this patent is extended or adjusted under 35 U.S.C. 154(b) by 0 days.

(21) Appl. No.: 13/707,178

(22) Filed: Dec. 6, 2012

(65) Prior Publication Data

US 2013/0112362 A1 May 9, 2013

Related U.S. Application Data

(62) Division of application No. 12/570,406, filed on Sep. 30, 2009, now Pat. No. 8,349,050.

(30) Foreign Application Priority Data

Sep. 21, 2009 (KR) ..... 10-2009-0088960

(51) Int. Cl.
*C22C 21/06* (2006.01)
*B22D 23/00* (2006.01)

(52) U.S. Cl.
USPC ..... 75/584; 75/600; 75/684; 75/686; 164/47

(58) Field of Classification Search
USPC ..... 164/47; 75/594, 686, 684, 600
See application file for complete search history.

(56) References Cited

U.S. PATENT DOCUMENTS

| | | | | |
|---|---|---|---|---|
| 4,460,407 | A | 7/1984 | Keith | |
| 4,705,561 | A * | 11/1987 | Green | 75/315 |
| 4,708,737 | A | 11/1987 | Skach, Jr. et al. | |
| 8,123,877 | B2 | 2/2012 | Tanizawa et al. | |
| 2005/0150577 | A1 | 7/2005 | Suzuki et al. | |
| 2008/0187454 | A1 * | 8/2008 | Tanizawa et al. | 420/407 |

FOREIGN PATENT DOCUMENTS

| | | |
|---|---|---|
| JP | 49-058018 | 6/1974 |
| JP | 54-125116 | 9/1979 |
| JP | 63-500391 | 2/1988 |
| JP | 03-505755 | 12/1991 |
| JP | 2001-003114 | 1/2001 |
| JP | 2007-254844 | 10/2007 |
| KR | 10-2004-0078220 | 9/2004 |
| KR | 10-2009-0071898 | 7/2009 |

OTHER PUBLICATIONS

Nushart, S. "Sieve and Fisher Subsieve Analysis of Metal Powders." Metal Powder Production and Characterization, vol. 7. ASM International, 1998. Web. Jul. 17, 2013. <http://products.asminternational.org/hbk/index.jsp>.*

* cited by examiner

*Primary Examiner* — George Wyszomierski
*Assistant Examiner* — Tima M McGuthry Banks

(57) ABSTRACT

The present invention relates to a desulfurizing agent of improved oxidation resistance, ignition resistance and productivity, and a method for manufacturing the desulfurizing agent. The desulfurizing agent may include a plurality of magnesium-aluminum alloy grains with grain boundaries, and a compound of one selected from consisting of magnesium and aluminum and one selected from consisting of alkaline metal and alkaline earth metal, the compound exists in the grain boundaries and is not inside but outside of the magnesium-aluminum alloy grains.

18 Claims, 9 Drawing Sheets

METHOD FOR MANUFACTURING DESULFURIZING AGENT

CROSS-REFERENCE TO RELATED APPLICATION

This application is a divisional of Shea Kwang Kim et al., U.S. patent application Ser. No. 12/570,406, filed on Sep. 30, 2009, now patented as U.S. Pat. No. 8,349,050 issued on Jan. 8, 2013, entitled "DESULFURIZING AGENT AND METHOD FOR MANUFACTURING THE SAME", which claims priority to and the benefit of Korean Patent Application No. 10-2009-0088960, filed on Sep. 21, 2009, which is herein incorporated by reference in its entirety.

BACKGROUND OF THE INVENTION

1. Field of the Invention

The present invention relates generally to a desulfurizing agent and a method for manufacturing the desulfurizing agent. More particularly, the present invention relates to a desulfurizing agent of improved oxidation resistance, ignition resistance and productivity. Further, the present invention relates to a method for manufacturing the desulfurizing agent of improved oxidation resistance, ignition resistance and productivity.

2. Description of the Related Art

High expectations are being placed on a magnesium alloy as a light-weight structural material because it is the lightest material among the already known practical metals, and has high specific strength and high specific stiffness. Magnesium is also being developed as a desulfurizing agent because of its exceptional desulfurizing ability. For example, magnesium can be used as a desulfurizing agent in a steel-making process for producing iron from iron sulfide contained in ore.

However, in a process for manufacturing magnesium alloy from a magnesium alloy solution that is molten at high temperature, magnesium alloy melt easily ignites. Also, magnesium alloy oxidizes very easily and it makes difficult to use magnesium as a desulfurizing agent. Because a magnesium alloy desulfurizing agent is used in powder or granule form, there is a strong need to improve grindability of the magnesium alloy.

SUMMARY OF THE INVENTION

Embodiments provide a desulfurizing agent of improved oxidation resistance, ignition resistance, and productivity, and a method for manufacturing the desulfurizing agent.

According to an embodiment, a desulfurizing agent includes a plurality of magnesium-aluminum alloy grains with grain boundaries; and a compound including a first metal selected from the group consisting of magnesium and aluminum and a second metal selected from the group consisting of alkaline metal and alkaline earth metal, the compound exists in the grain boundaries and is not inside but outside of the magnesium-aluminum alloy grains.

The aluminum may be contained in the magnesium-aluminum alloy grains in a fraction ranging from about 40 wt % to about 65 wt %.

The alkaline earth metal forming the compound may be calcium.

The calcium may be contained in the magnesium-aluminum alloy grains in a fraction ranging from about 0.5 wt % to about 50 wt %.

The desulfurizing agent may further include calcium oxide (CaO) in the grain boundaries.

The calcium oxide may has a size ranging from about 0.1 μm to about 500 μm.

An ignition temperature of the desulfurizing agent may range from about 1100° C. to about 1500° C.

According to an another embodiment, a desulfurizing agent includes a plurality of magnesium-aluminum alloy grains with grain boundaries; and a compound including an aluminum and calcium.

According to another embodiment, a method for manufacturing a desulfurizing agent includes melting magnesium-aluminum alloy in a crucible at a temperature ranging from about 400° C. to about 800° C. to form a magnesium-aluminum alloy melt; adding an additive of alkaline metal compound or alkaline earth metal compound to the magnesium-aluminum alloy melt; stirring the magnesium-aluminum alloy melt for about 1 minute to about 400 minutes; casting the magnesium-aluminum alloy melt in a mold at a room temperature to about 400; and cooling the magnesium-aluminum alloy casting.

In the melting of the magnesium-aluminum alloy, the magnesium-aluminum alloy melt may contain from about 40 wt % to about 65 wt % aluminum.

The adding of the additive includes adding calcium oxide (CaO) to the magnesium-aluminum alloy melt.

The adding of the additive includes adding the calcium oxide (CaO) to the magnesium-aluminum alloy melt, so that the magnesium-aluminum alloy melt contains about 0.5 wt % to about 50 wt % calcium.

The method may further include, after the cooling, grinding the cooled magnesium-aluminum alloy casting to powder or granules.

These and other features of the present invention will be more readily apparent from the detailed description set forth below taken in conjunction with the accompanying drawings.

BRIEF DESCRIPTION OF THE DRAWINGS

The above and other features and advantages will become more apparent to those of ordinary skill in the art by describing in detail exemplary embodiments with reference to the attached drawings, in which.

In the following description, the same or similar elements are labeled with the same or similar reference numbers.

DETAILED DESCRIPTION

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Preferred embodiments of the present invention will now be described in detail with reference to the accompanying drawings.

Figure 1:
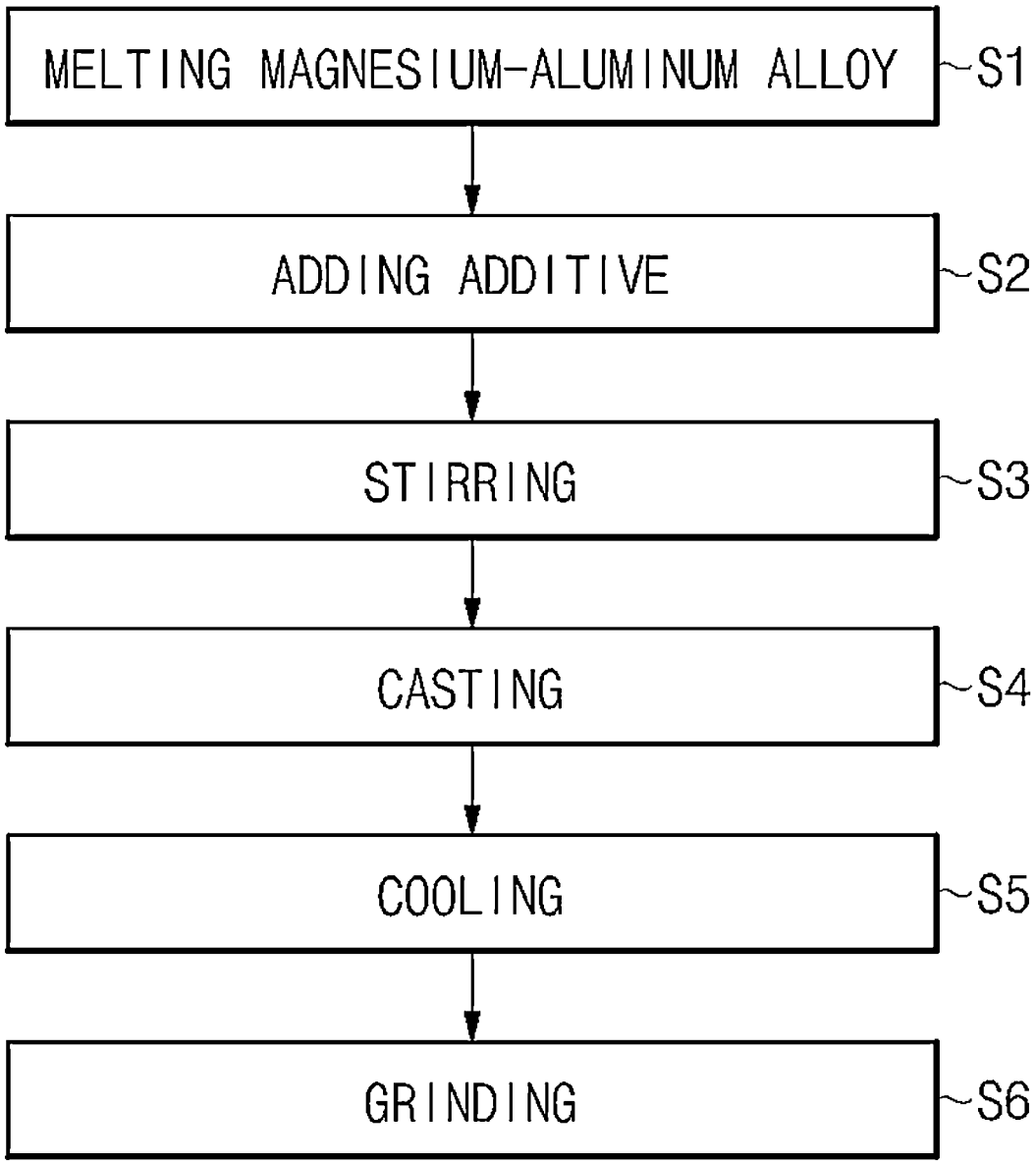
FIG. 1 is a flow diagram illustrating a method for manufacturing a desulfurizing agent according to an embodiment.

FIG. 1 is a flow diagram illustrating a method for manufacturing a desulfurizing agent according to an embodiment;

Referring now to FIG. 1, the method includes melting magnesium-aluminum alloy operation S1, adding an additive operation S2, stirring operation S3, casting operation S4, and cooling operation S5. In addition, the method may further include grinding operation S6, after the cooling operation S5.

In the melting magnesium-aluminum alloy operation S1, the magnesium-aluminum alloy (Mg—Al alloy) is placed in a crucible, and heated to about 400° C.~800° C. Then, the magnesium-aluminum alloy in the crucible is molten to form a magnesium-aluminum alloy melt. If the temperature is lower than about 400° C., it is difficult to form the magnesium-aluminum alloy. If the temperature is higher than about 800° C., ignition may easily occur in the magnesium-aluminum alloy melt.

In the melting magnesium-aluminum alloy operation S1, the desulfurizing agent may contain about 40 wt %~65 wt % aluminum. If aluminum is contained above about 40 wt % in the magnesium-aluminum alloy, aluminum may act as a reducing agent for magnesium, thereby preventing oxidation of magnesium to improve ignition resistance of the magnesium-aluminum alloy, and may facilitate grinding of the magnesium-aluminum alloy in the grinding operation S6, thereby improving productivity. If aluminum is contained below about 65 wt %, the magnesium-aluminum alloy may improve in ignition resistance, desulfurization efficiency with the content of aluminum, and grindability.

Also, a small amount of shield gas may be provided additionally to prevent ignition of the magnesium-aluminum alloy melt. As the shield gas for preventing ignition of magnesium, typical $SF_6$, $SO_2$, $CO_2$, HFC-134*a*, Novec™612, inert gas or an equivalent thereof, or a mixture thereof may be used to prevent ignition of the magnesium. It should be noted that the listing of the above materials should not be seen as to limit the scope of the present invention. Other materials may be used without departing from the spirit and scope of the present invention.

In the adding an additive operation S2, an additive powder is added to the magnesium-aluminum alloy melt. The additive may be formed of at least one selected from consisting of an alkaline metal compound and an alkaline earth metal compound. Particularly, the additive may be formed of calcium oxide (CaO). The additive combines with magnesium or aluminum to form dense particles, thereby reducing oxidation and increasing an ignition temperature of magnesium in the magnesium-aluminum alloy melt. Accordingly, in the desulfurization process, the additive may prevent the magnesium from reacting with oxygen in the air so that the magnesium reacts with sulfur in the molten iron, thereby improving the desulfurization efficiency and reducing the required amount of the shield gas.

In a preferred embodiment, the additive used in the adding an additive operation S2 may be calcium oxide (CaO). The calcium oxide may be added in an amount such that the content of the calcium (Ca) in the desulfurizing agent ranges from about 0.5 wt % to about 50 wt %. If calcium is added above about 0.5 wt %, the effect (reducing oxidation, increasing ignition temperature, and reducing shield gas requirement) of the additive may improve. If calcium is added below about 50 wt %, the magnesium-aluminum alloy may keep its typical characteristics.

The additive used in the operation of adding an additive may have a size ranging from about 0.1 μm to about 500 μm. If the additive is larger than 0.1 μm, the additive can be manufactured actually. If the additive is smaller than about 500 μm, the additive may easily react in the magnesium-aluminum alloy melt.

In the stirring operation S3, the magnesium-aluminum alloy melt is stirred for about 1 minute to about 400 minutes. If the stirring is performed shorter than about 1 minute, the additive may not be sufficiently mixed in the magnesium-aluminum alloy melt, and if the stirring is performed longer than about 400 minutes, further stirring may be unnecessary.

The additive reacts in the magnesium-aluminum alloy melt. When calcium oxide (CaO) is added as an additive in the magnesium-aluminum alloy melt, the calcium (Ca) is reduced and combines with magnesium or aluminum to form an additive compound. The thus-formed additive compound may be $Al_2Ca$, $(Mg,Al)_2Ca$, $Mg_2Ca$, and the like, which may improve the ignition resistance of the magnesium-aluminum alloy melt.

A portion of the calcium oxide (CaO) additive may not react and remain in the melt. In the case, because the calcium oxide (CaO) also has a high desulfurizing ability, the calcium oxide remaining in the magnesium-aluminum alloy melt may act as a desulfurizing agent.

In the stirring operation S3, the additive does not exist in the grain of the magnesium-aluminum alloy, but exists out of the grain, i.e., in the grain boundaries, in the form of an intermetallic compound. That is, in the stirring operation S3, the additive exists in the form of an additive compound, more particularly, in the form of $Al_2Ca$, $(Mg,Al)_2Ca$, $Mg_2Ca$, and the like, which may improve the ignition resistance of the magnesium-aluminum alloy.

Magnesium has low boiling point, and thus, when added in the melt, has a tendency to rise to the surface. Calcium (Ca)

added by the additive may reduce vapor pressure of magnesium in the magnesium-aluminum alloy crystal, thereby inducing a silent process.

The other element, oxygen ($O_2$), of the additive floats on the surface of the magnesium melt, and thus can be removed manually or using an automatic apparatus.

In the casting operation S4, the magnesium-aluminum alloy melt is casted in a mold at a room temperature to about 400° C.

The mold may be one selected from the group consisting of metal mold, ceramic mold, graphite mold, and equivalents thereof may be used. In addition, the casting may be performed using gravity die-casting, continuous casting, or an equivalent thereof. It should be noted that other types of mold may be used without departing from the spirit and scope of the present invention. Further, it should be noted that the casting method is not limited to the above mentioned methods without departing from the spirit and scope of the present invention.

In the cooling operation S5, the mold is cooled down to a room temperature, and then the magnesium-aluminum alloy (e.g., magnesium-aluminum alloy ingot) is taken out of the mold.

The magnesium-aluminum alloy manufactured as described above includes a plurality of magnesium-aluminum alloy grains with grain boundaries, and an intermetallic compound in the grain boundaries, which are not the inside, but the outside of the magnesium-aluminum alloy grains. This will be described below.

A material added during the process for manufacturing the magnesium-aluminum alloy is simply defined as an additive, and a material added in the thus-manufactured magnesium-aluminum alloy is defined as an additive compound. This is because a material added in the manufactured magnesium alloy is in the form of an intermetallic compound.

The grinding operation S6 is an operation to grind the magnesium-aluminum alloy (ingot) at a room temperature to form the desulfurizing agent in powder or granule form. The grinding may be performed through a typical grinding method using a grinding apparatus, such as a hammer and a milling drum machine. The magnesium-aluminum alloy is brittle, i.e., has high grindability. Accordingly, by grinding the magnesium-aluminum alloy, it is possible to improve the work efficiency, and thus to improve the productivity of the desulfurizing agent.

Figure 2:
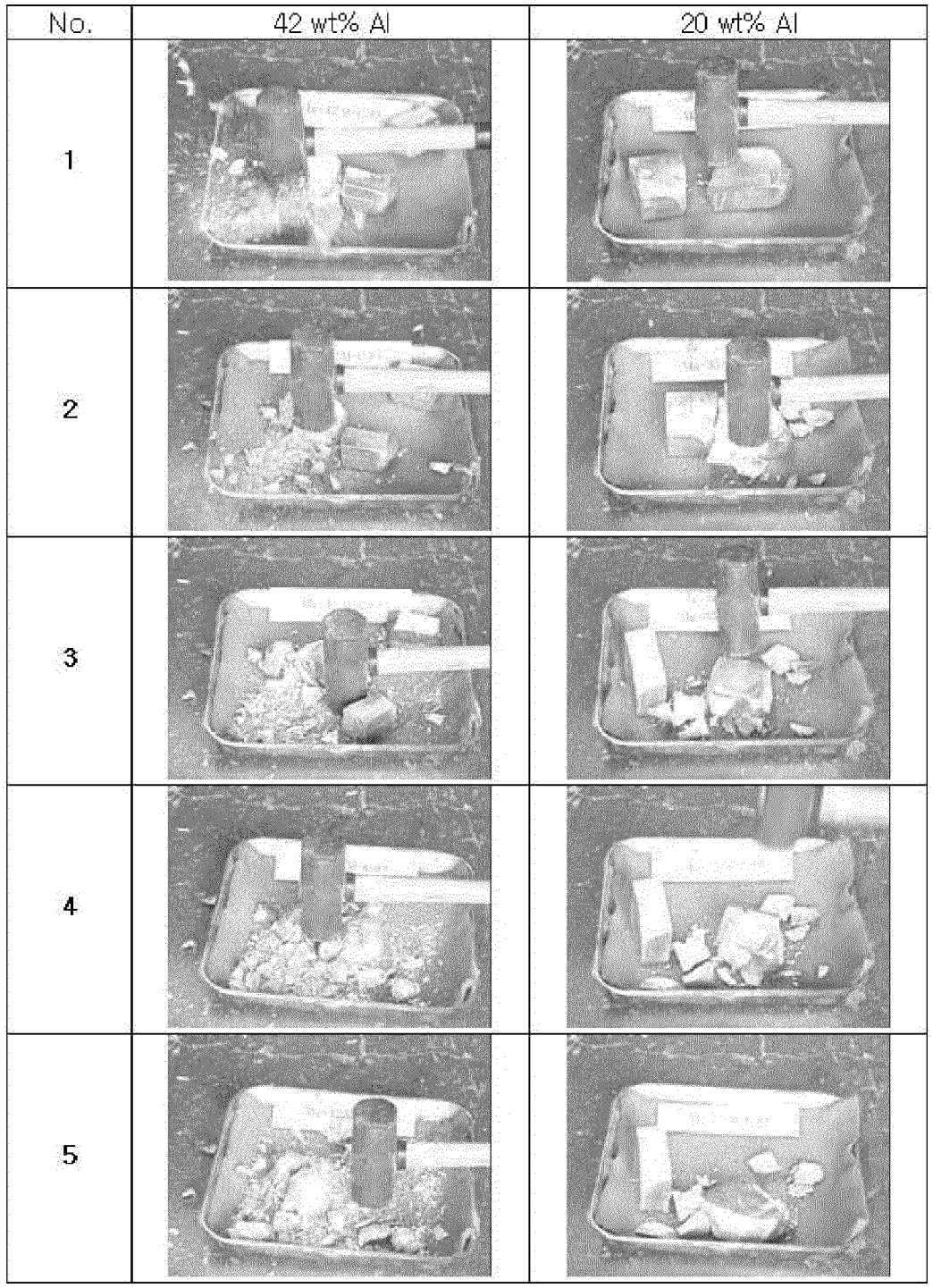
FIG. 2 is a view comparing grindabilities of a desulfurizing agent containing 42 wt % aluminum and a desulfurizing agent containing 20 wt % aluminum.

FIG. 2 compares results of grindability tests that were performed by crushing desulfurizing agents containing 42 wt % aluminum and 20 wt % aluminum, respectively, by a hammer with a constant force. In each test, the magnesium-aluminum alloy was applied with a 30 N force through the hammer.

When the same force was applied, the desulfurizing agent containing 42 wt % aluminum was ground more easily than that containing 20 wt % aluminum. Accordingly, by controlling the aluminum content between about 40 wt % and about 65 wt %, the productivity of the desulfurizing agent could be improved.

Constitution of a desulfurizing agent according to an embodiment will be described in detail below.

Figure 3:
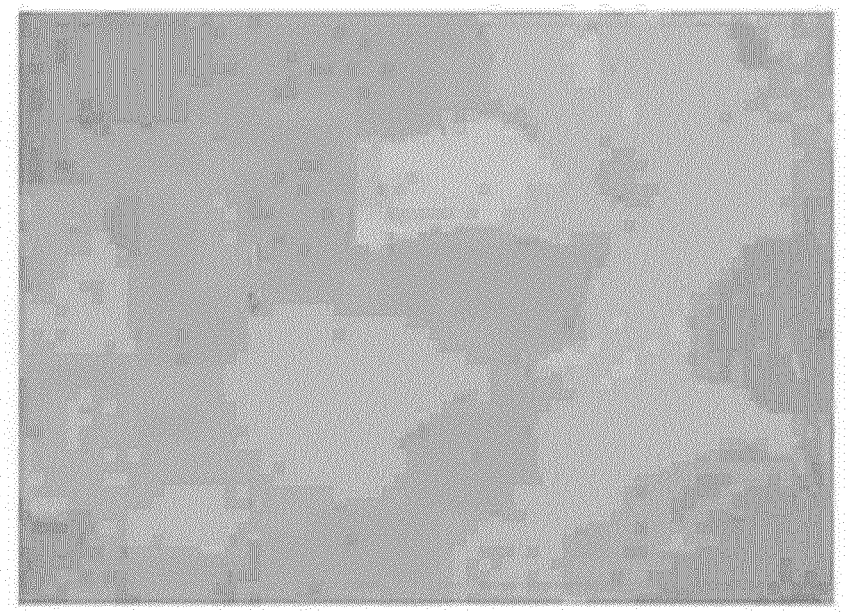
FIG. 3 is a micrograph illustrating a microstructure of a pure magnesium.
Figure 4A:
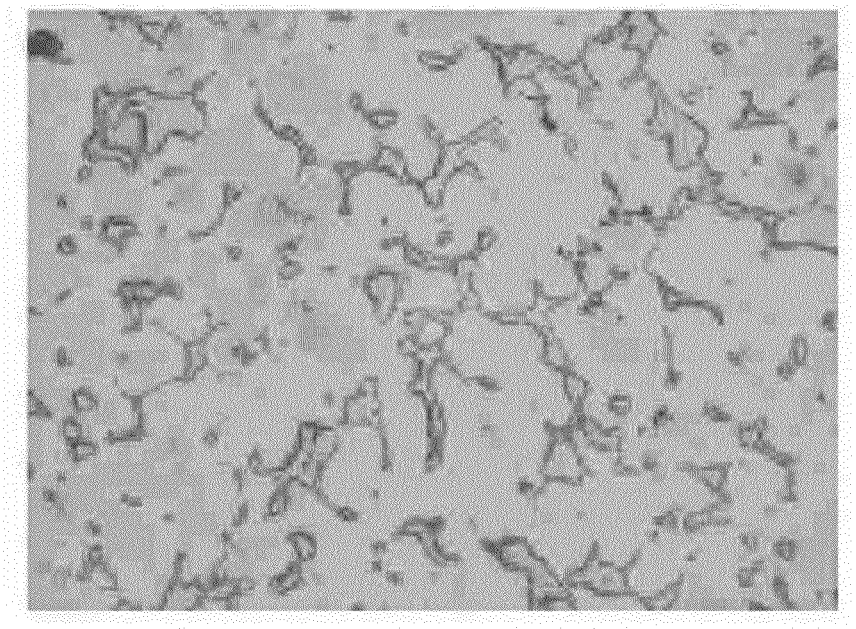
FIGS. 4A and 4B are micrographs illustrating microstructures of magnesium-aluminum alloy desulfurizing agents containing different fractions of calcium oxide, 42 wt % aluminum, and the balance magnesium, according to an embodiment.
Figure 4B:
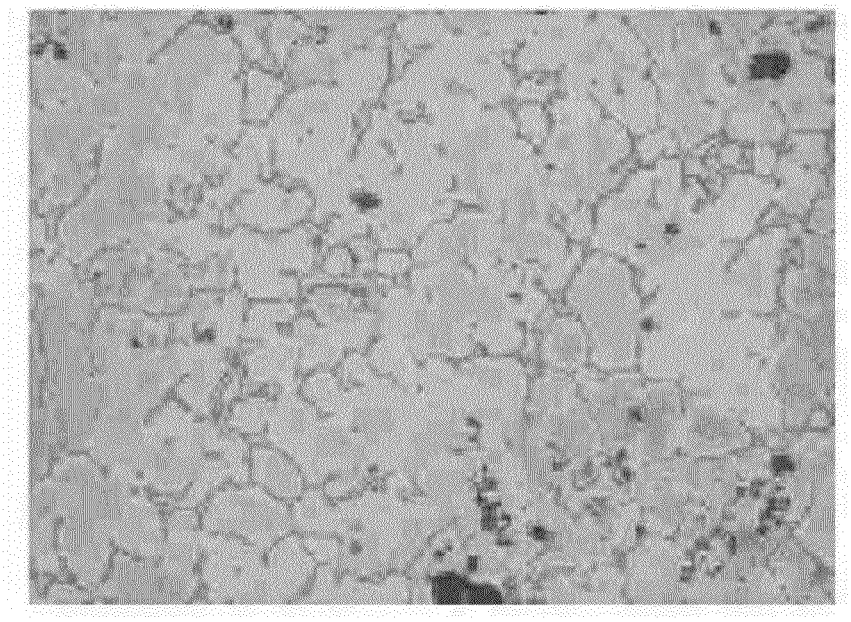

FIG. 3 is a micrograph illustrating a microstructure of pure magnesium. FIGS. 4A and 4B are micrographs illustrating microstructures of magnesium-aluminum alloy desulfurizing agents containing different fractions of calcium oxide, according to an embodiment.

As shown in FIG. 3, no additive compound was observed in grain boundaries of the pure magnesium. In addition, although not shown in FIG. 3, when calcium oxide (CaO) was added to form an additive compound, the additive compound existed inside the grains.

The magnesium-aluminum alloy of FIG. 4A was manufactured by adding 1.5 wt % calcium oxide to a magnesium-aluminum alloy containing 42 wt % aluminum. The magnesium-aluminum alloy of FIG. 4B was manufactured by adding 3.5 wt % calcium oxide to a magnesium-aluminum alloy containing 42 wt % aluminum.

From FIGS. 4A and 4B, it can be seen that, as more calcium oxide was added to the magnesium-aluminum alloy, more additive compounds were formed in the grain boundaries. Here, the additive compound formed by the addition of the calcium oxide was formed in the grain boundaries, not inside the grain. The additive compound has a form of $Al_2Ca$, $(Mg, Al)_2Ca$, $Mg_2Ca$, or the like. That is, calcium (Ca) of the calcium oxide additive is reduced and reacts with magnesium (Mg) or aluminum (Al) to thus refine the microstructure and form an additive compound in the grain boundaries. As a result, the magnesium-aluminum alloy melt improves in the oxidation resistance and the ignition resistance. Black spots shown in FIGS. 4A and 4B are calcium oxides (CaO) remaining without reactions. The calcium oxide (CaO) also has a high desulfurizing ability, and thus the remaining calcium oxide (CaO) may also contribute to the desulfurization efficiency in the desulfurizing agent according to the embodiment.

Figure 5A:
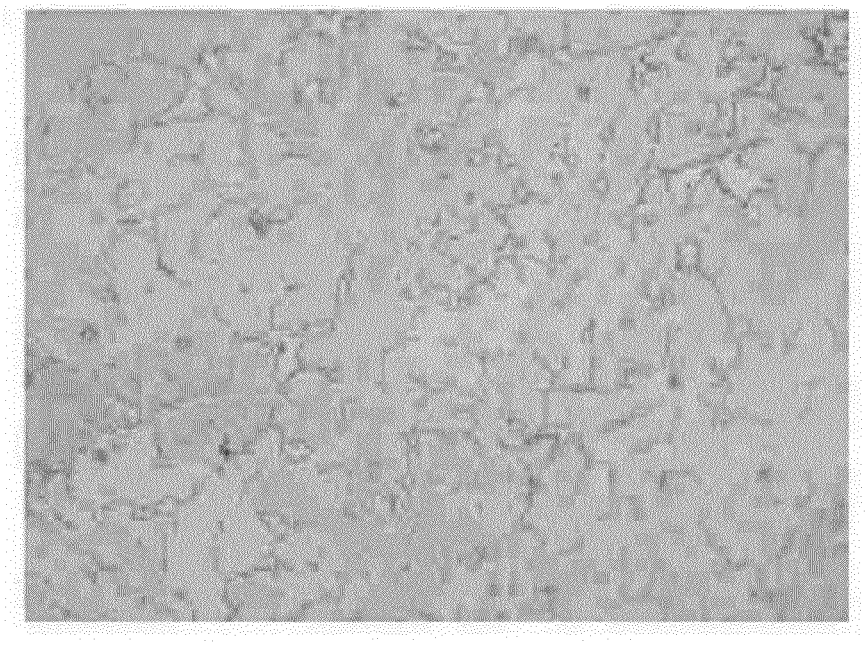
FIGS. 5A and 5B are micrographs illustrating microstructures of magnesium-aluminum alloy desulfurizing agents containing different fractions of calcium oxide, 56 wt % aluminum, and the balance magnesium, according to an embodiment.
Figure 5B:
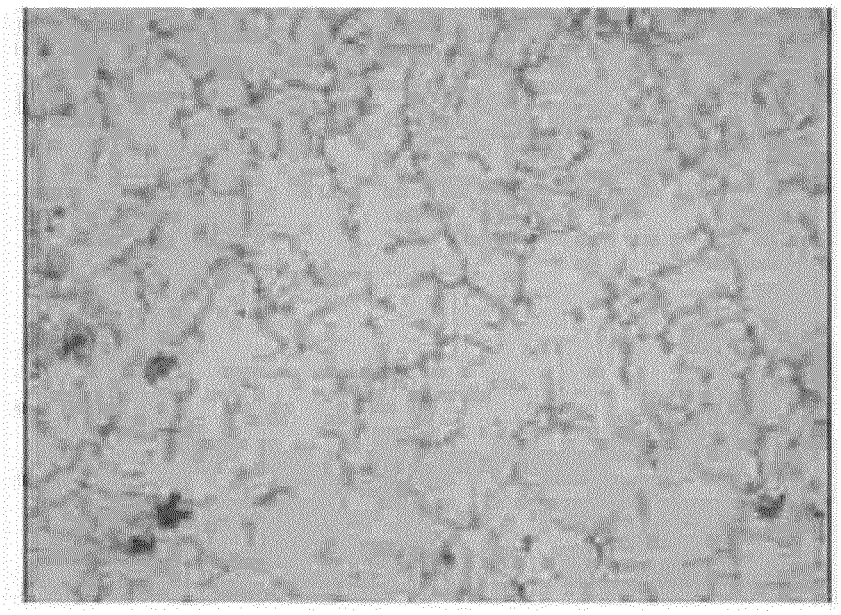

The magnesium-aluminum alloy of FIG. 5A was manufactured by adding 2.2 wt % calcium oxide to a magnesium-aluminum alloy containing 56 wt % aluminum. The magnesium-aluminum alloy of FIG. 5B was manufactured by adding 3.7 wt % calcium oxide to a magnesium-aluminum alloy containing 56 wt % aluminum.

Comparing FIGS. 5A and 5B, and FIGS. 4A and 4B, it can be seen that as more aluminum and calcium oxide were added, more refined microstructure was obtained, and more additive compounds were formed in the grain boundaries. Accordingly, it can be confirmed that by increasing the content of aluminum and calcium oxide, the magnesium-aluminum alloy melt according to the embodiment can improve in oxidation resistance and ignition resistance.

The grindability of a desulfurizing agent according to an embodiment will be described.

Figure 6:
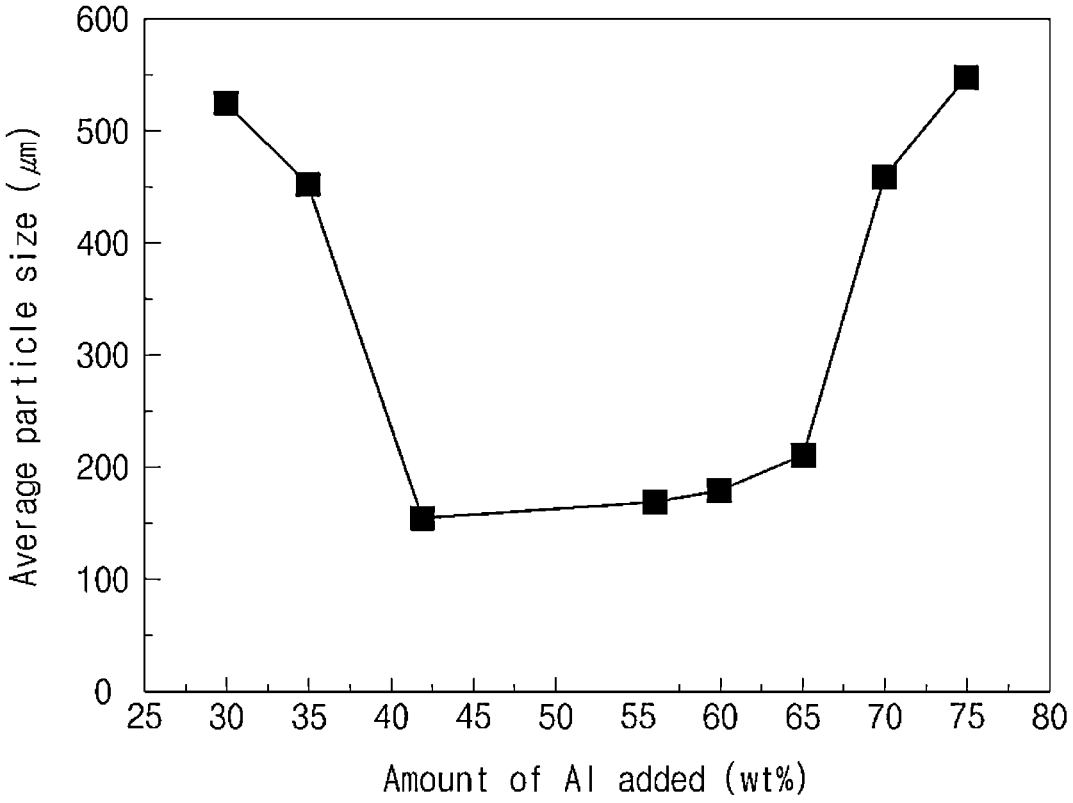
FIG. 6 is a graph illustrating a result of a grindability test of a magnesium-aluminum alloy desulfurizing agent according to an embodiment.

FIG. 6 is a graph illustrating a result of a grindability test of a magnesium-aluminum alloy desulfurizing agent according to an embodiment.

In FIG. 6, X axis represents wt % of aluminum, and Y axis represents average particle size (μm). The test was performed by adding 10 wt % calcium oxide to magnesium-aluminum alloy melts with gradually increasing wt % of aluminum. In addition, the grinding was performed using a milling drum machine at a rotation speed of 50 rpm.

The test results of FIG. 6 are listed in Table 1.

TABLE 1

| Weight ratio of aluminum (wt %) | Average particle size (μm) |
|---|---|
| 30 | 525 |
| 35 | 452 |
| 40 | 153 |
| 56 | 168 |
| 60 | 179 |
| 65 | 210 |
| 70 | 458 |
| 75 | 549 |

From FIG. 6 and Table 1, it can be seen that as the weight ratio of aluminum increased, the average particle size decreased to a certain point and then increased again. That is, the average particle size was 525 μm when the aluminum content was 30 wt %, however, it decreased to 452 μm when the aluminum content was 35 wt %, and significantly decreased to 153 μm when the aluminum content was 40 wt %. The average particle size was the smallest when the aluminum content ranged from 40 wt % to 65 wt %. That is, the desulfurizing agent according to the embodiment had the best grindability when the aluminum content ranged from 40 wt % to 65 wt %. Meanwhile, the average particle size significantly increased when the aluminum content increased above 65 wt %.

Accordingly, as described above, it can be confirmed that, when about 40 wt % to 65 wt % aluminum is contained, desulfurizing agent according to the embodiment improves in the grindability, thereby increasing the productivity.

The oxidation resistance of a desulfurizing agent according to an embodiment will be described.

Figure 7:
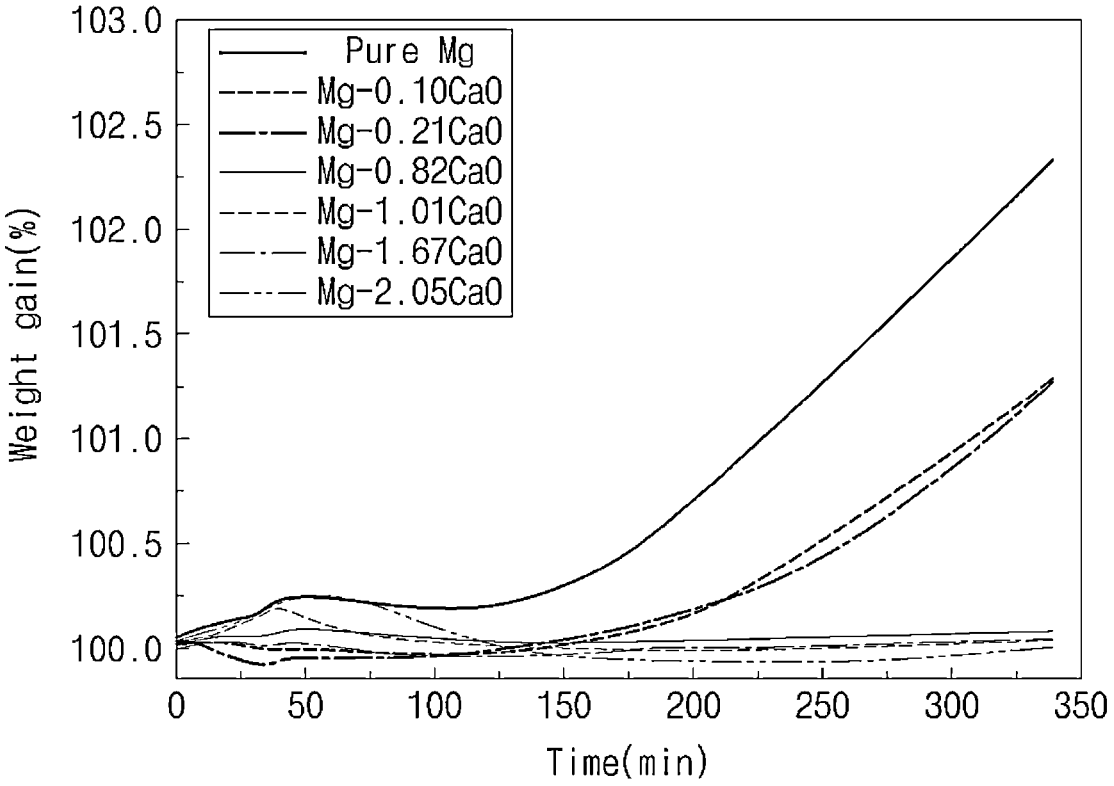
FIG. 7 is a graph illustrating a result of an oxidation test of a magnesium-aluminum alloy desulfurizing agent according to an embodiment.

FIG. 7 is a graph illustrating a result of an oxidation test according to the variation of the amount of calcium oxide added in a magnesium-aluminum alloy desulfurizing agent according to an embodiment.

In FIG. 7, X axis represents elapsed time (min), and Y axis represents amount of oxidation. Y axis values begin at 100. The test was performed by gradually increasing the content of calcium oxide additive in a pure magnesium from 0.10 wt % to 2.05 wt %.

As shown in FIG. 7, in pure magnesium, oxidation occurred as time went by, thereby increasing Y value. In a magnesium added with calcium oxide (CaO), the amount of oxidation (Y value) increased with time, however, it was small in comparison with that of the pure magnesium. Further, in the cases where the calcium oxide content ranged from 0.82 wt % to 2.05 wt %, the oxidation amount increased little with time.

Accordingly, it can be confirmed that the magnesium-aluminum alloy desulfurizing agent according to the embodiment can decrease the amount of oxidation, thereby improving oxidation resistance.

The ignition resistance of a desulfurizing agent according to an embodiment will be described.

Figure 8A:
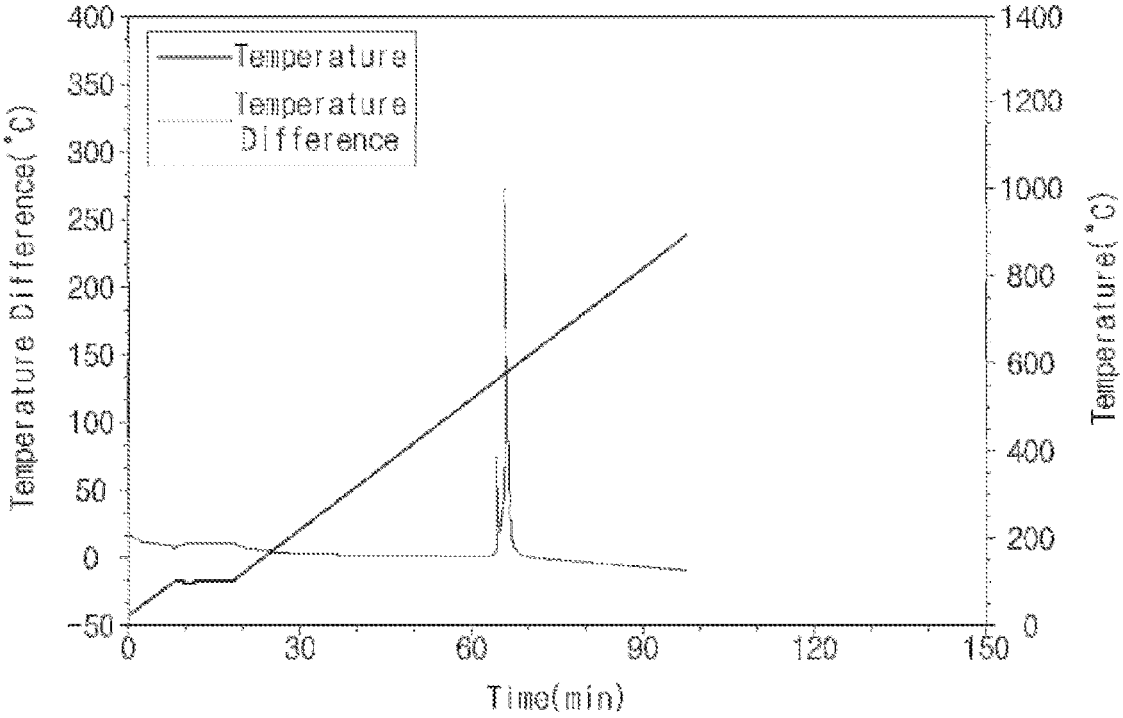
FIGS. 8A and 8B are graphs illustrating a result of an ignition test of a magnesium-aluminum alloy desulfurizing agent according to an embodiment.
Figure 8B:
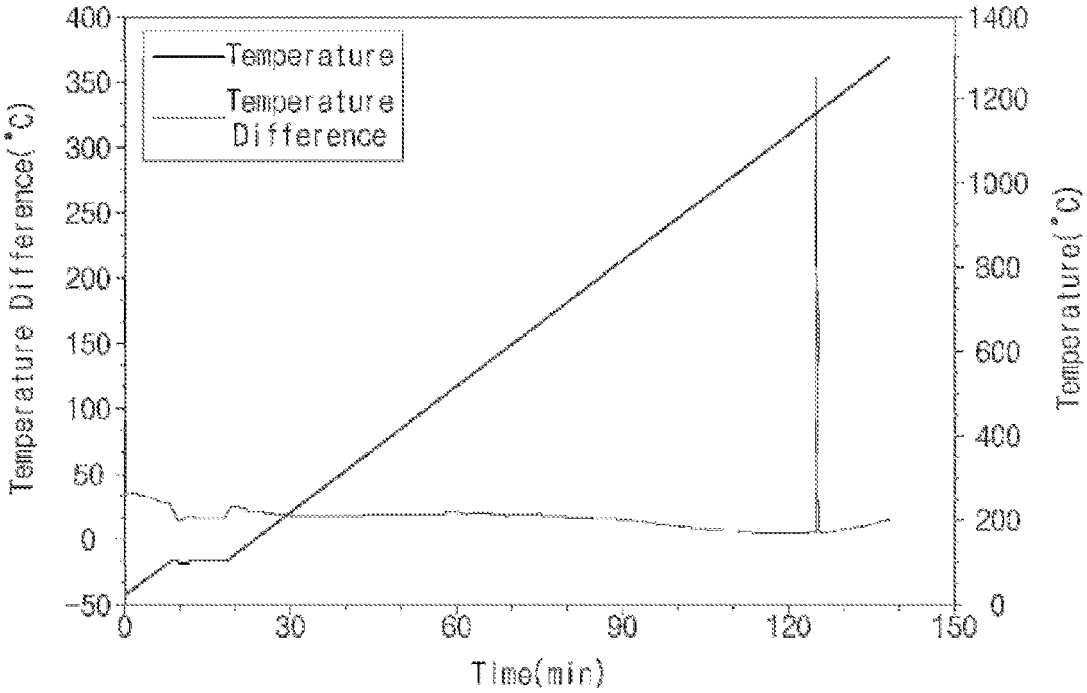

FIG. 8A is a graph illustrating a result of an ignition test of pure magnesium. FIG. 8B is a graph illustrating a result of an ignition test of a magnesium-aluminum alloy desulfurizing agent according to an embodiment.

In FIGS. 8A and 8B, X axis represents heating time (min) of calcium oxide, and Y axis represents temperature (°C). The test of FIG. 8B was performed by adding 3.5 wt % calcium oxide to a magnesium-aluminum alloy melt containing 42 wt % aluminum.

Referring to FIG. 8A, ignition occurs at a temperature where a temperature curve (thick line) intersects a temperature difference curve (thin line). From FIG. 8A, it can be seen that the ignition temperature of the pure magnesium was about 580° C.

Referring to FIG. 8B, it can be seen that the ignition temperature of the magnesium-aluminum alloy added with 42 wt % aluminum and 3.5 wt % calcium oxide was about 1170° C., which was higher than that of the pure magnesium of FIG. 8A. Also, the ignition temperature was formed at a temperature range from about 1100° C. to about 1500° C. Accordingly, it can be confirmed that the ignition temperature of the magnesium-aluminum alloy desulfurizing agent according to the embodiment is higher than that of a pure magnesium.

As described above, the desulfurizing agent formed of magnesium-aluminum alloy according to the embodiments can improve in ignition resistance, and grindability, and thus productivity. In addition, the desulfurizing agent formed of magnesium-aluminum alloy added with calcium oxide according to the embodiments can improve in oxidation resistance and ignition resistance.

The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A method for manufacturing a desulfurizing agent, the method comprising:

melting magnesium-aluminum alloy in a crucible at a temperature ranging from about 400° C. to about 800° C. to form a magnesium-aluminum alloy melt;

adding an additive selected from the group consisting of alkaline metal compound and alkaline earth metal compound to the magnesium-aluminum alloy melt;

stirring the magnesium-aluminum alloy melt for about 1 minute to about 400 minutes;

casting the magnesium-aluminum alloy melt in a mold at a room temperature to about 400° C. to form a magnesium-aluminum casting; and cooling the magnesium-aluminum alloy casting, wherein the magnesiam-aluminum alloy melt comprises from about 40 wt % to about 65 wt % aluminum.

2. The method of claim 1 wherein the additive is calcium oxide (CaO).

3. The method of claim 2 wherein the calcium oxide (CaO) has a size ranging from about 0.1 μm to about 500 μm.

4. The method of claim 3 wherein the calcium oxide (CaO) is added to make the weight percent of calcium contained in the magnesium-aluminum alloy melt ranging from about 0.5 wt % to about 50 wt %.

5. The method of claim 1 further comprising grinding the magnesium-aluminum alloy casting after the cooling.

6. A method for manufacturing a desulfurizing agent, the method comprising:

melting magnesium-aluminum alloy in a crucible to form a magnesium-aluminum alloy melt;

adding an additive selected from the group consisting of alkaline metal compound and alkaline earth metal compound to the magnesium-aluminum alloy melt;

stirring the magnesium-aluminum alloy melt whereby forming a compound;

casting the magnesium-aluminum alloy melt in a mold to form a magnesium-aluminum casting; and cooling the magnesium-aluminum alloy casting, wherein the cooled magnesium-aluminum alloy casting comprises a plurality of magnesium-aluminum alloy grains with grain boundaries, the compound exists in the grain boundaries.

7. The method of claim 6 wherein the additive is calcium oxide (CaO).

8. The method of claim 7 wherein the calcium oxide (CaO) has a size ranging from about 0.1 μm to about 500 μm.

9. The method of claim 8 wherein the compound formed in the step of stirring the magnesium-aluminum alloy melt is selected from the group consisting of $Al_2Ca$, $(Mg,Al)_2Ca$, and $Mg_2Ca$.

10. The method of claim 8 wherein the calcium oxide (CaO) is added to make the weight percent of calcium contained in the magnesium-aluminum alloy melt ranging from about 0.5 wt % to about 50 wt %.

11. The method of claim 6 wherein the magnesium-aluminum alloy melt comprises from about 40 wt % to about 65 wt % aluminum.

12. The method of claim 6 further comprising grinding the magnesium-aluminum alloy casting after the cooling.

13. The method of claim 12 wherein the magnesium-aluminum alloy melt comprises from about 40 wt % to about 65 wt % aluminum.

14. The method of claim 6 wherein the melting is done at a temperature ranging from about 400° C. to about 800° C.

15. The method of claim 14 wherein the magnesium-aluminum alloy melt comprises from about 40 wt % to about 65 wt % aluminum.

16. The method of claim 15 wherein the casting is done at a room temperature to about 400° C.

17. The method of claim 6 wherein the stirring is done for about 1 minute to about 400 minutes.

18. The method of claim 6 wherein the casting is done at a room temperature to about 400° C.

* * * * *